US010502034B2

(12) United States Patent
Yee et al.

(10) Patent No.: US 10,502,034 B2
(45) Date of Patent: Dec. 10, 2019

(54) EXPANSION CONE WITH ROTATIONAL LOCK

(71) Applicant: Enventure Global Technology, Inc., Houston, TX (US)

(72) Inventors: Chee Kong Yee, Katy, TX (US); Frederick Cornell Bennett, Houston, TX (US); Eric James Connor, Katy, TX (US)

(73) Assignee: Enventure Global Technology, Inc., Houston, TX (US)

( * ) Notice: Subject to any disclaimer, the term of this patent is extended or adjusted under 35 U.S.C. 154(b) by 0 days.

(21) Appl. No.: 15/740,033

(22) PCT Filed: Jun. 30, 2016

(86) PCT No.: PCT/US2016/040321
§ 371 (c)(1),
(2) Date: Dec. 27, 2017

(87) PCT Pub. No.: WO2017/004336
PCT Pub. Date: Jan. 5, 2017

(65) Prior Publication Data

US 2018/0187524 A1 Jul. 5, 2018

Related U.S. Application Data

(60) Provisional application No. 62/187,648, filed on Jul. 1, 2015.

(51) Int. Cl.
*E21B 43/10* (2006.01)
*E21B 23/02* (2006.01)
(Continued)

(52) U.S. Cl.
CPC ..... *E21B 43/105* (2013.01); *E21B 23/02* (2013.01); *E21B 33/146* (2013.01); *E21B 43/106* (2013.01); *B21D 39/20* (2013.01)

(58) Field of Classification Search
CPC ..... E21B 43/105; E21B 23/02; E21B 33/146; E21B 43/106
See application file for complete search history.

(56) References Cited

U.S. PATENT DOCUMENTS 3,148,731 A 9/1964 Holden
3,203,451 A * 8/1965 Vincent ..... B29D 22/00 138/143
(Continued)

FOREIGN PATENT DOCUMENTS

WO 2007017355 A1 2/2007

OTHER PUBLICATIONS

International Search Report and Written Opinion dated Nov. 7, 2018 for corresponding Application No. PCT/US2016/040321, 12 pages.
(Continued)

*Primary Examiner* — D. Andrews
(74) *Attorney, Agent, or Firm* — Jonathan M. Pierce; Porter Hedges LLP

(57) ABSTRACT

An expandable tubular having a receptacle at its lower end is installed in a wellbore. An axial force is generated on a solid cone assembly to push the solid cone assembly. The solid cone assembly includes a cone body formed from a drillable material, the cone body having an expansion surface, a first expansion profile formed in a first portion of the expansion surface, and a second expansion profile formed in a second portion of the expansion surface. The second expansion profile includes one or more facets. The facets of the second expansion profile engage the receptacle, providing a rotational lock to the cone body. After expansion of the expandable tubular, the cone body may be drilled or milled.

14 Claims, 9 Drawing Sheets

(51) Int. Cl.
*E21B 33/14* (2006.01)
*B21D 39/20* (2006.01)

(56) References Cited

U.S. PATENT DOCUMENTS

| | | | | |
|---|---|---|---|---|
| 6,112,818 | A | 9/2000 | Campbell | |
| 7,325,602 | B2 | 2/2008 | Cook et al. | |
| 8,770,276 | B1 | 7/2014 | Nish et al. | |
| 2005/0056434 | A1 | 3/2005 | Watson et al. | |
| 2005/0194129 | A1* | 9/2005 | Campo | E21B 21/103 166/207 |
| 2006/0096762 | A1 | 5/2006 | Brisco | |
| 2006/0243444 | A1 | 7/2006 | Lohbeck et al. | |
| 2007/0102165 | A1 | 5/2007 | Slup et al. | |
| 2007/0277972 | A1 | 12/2007 | Shuster et al. | |
| 2008/0023194 | A1 | 1/2008 | Noel et al. | |
| 2008/0156499 | A1 | 7/2008 | Giroux et al. | |
| 2008/0223568 | A1 | 9/2008 | Roggeband et al. | |
| 2009/0266560 | A1 | 10/2009 | Ring et al. | |
| 2010/0044030 | A1 | 2/2010 | Whiddon et al. | |
| 2010/0089592 | A1 | 4/2010 | Ring et al. | |
| 2011/0011578 | A1 | 1/2011 | Noel | |
| 2012/0037381 | A1 | 2/2012 | Giroux et al. | |
| 2012/0152567 | A1 | 6/2012 | Whiddon et al. | |
| 2013/0299197 | A1* | 11/2013 | Bennett | E21B 43/105 166/384 |
| 2014/0054047 | A1 | 2/2014 | Zhou | |
| 2017/0284176 | A1 | 10/2017 | Bennett | |

OTHER PUBLICATIONS

International Preliminary Report on Patentability dated Jan. 11, 2018 for corresponding Application No. PCT/US2016/040321, 9 pages.

* cited by examiner

EXPANSION CONE WITH ROTATIONAL LOCK

BACKGROUND

This disclosure relates generally to methods and apparatus for drilling a wellbore. More specifically, this disclosure relates to methods and apparatus for installing an expandable tubular that has, after expansion, essentially the same diameter as a previous base casing.

In the oil and gas industry, expandable tubulars are often used for casing, liners and the like. To create a casing, for example, an expandable tubular is installed in a wellbore and subsequently expanded by displacing an expansion cone through the expandable tubular. The expansion cone may be pushed or pulled using mechanical means, such as by a support tubular coupled thereto, or driven by hydraulic pressure. As the expansion cone is displaced axially within the expandable tubular, the expansion cone imparts radial force to the inner surface of the expandable tubular. In response to the radial force, the expandable tubular is plastically deformed, thereby permanently increasing both its inner and outer diameters. In other words, the expandable tubular expands radially.

Expandable tubulars often include a shoe assembly coupled to the lower end of the tubular that enables cementing operations to be performed through the expandable tubular. Once the expandable tubular is installed, the shoe assembly has to be removed to allow drilling to continue. This is often accomplished by milling or drilling out the shoe assembly. The shoe assembly may be constructed from composite materials, cast iron, or other materials that simplify the removal of the shoe assembly.

In certain expandable tubular applications, a portion of the expandable tubular adjacent to the shoe assembly is left unexpanded while the tubular above that portion is expanded. The unexpanded portion creates a diametrical constriction that must also be removed before drilling ahead. Removing both the unexpanded portion and the shoe assembly has conventionally involved multiple trips into the wellbore for milling and fishing, or the utilization of complex tools that may be prone to malfunction.

Thus, there is a continuing need in the art for methods and apparatus for providing a shoe assembly that reduces the time needed to prepare the wellbore prior to restarting drilling operations.

SUMMARY OF THE DISCLOSURE

In one or more aspects, the present disclosure relates to a solid cone assembly comprising a cone body having an expansion surface, a first expansion profile formed in a first portion of the expansion surface, and a second expansion profile formed in a second portion of the expansion surface, wherein the second expansion profile includes one or more facets. The solid cone assembly may further comprise a seal member coupled to an outer surface of the cone body. The seal member may include a first seal facing in one direction and a second seal facing in an opposite direction. The solid cone assembly may further comprise a bore disposed in the cone body. The solid cone assembly may further comprise a seal seat formed in the bore. The solid cone assembly may further comprise a flapper valve and shear tube disposed in the bore. The solid cone assembly may further comprise a locking member coupled to the cone body. The solid cone assembly may further comprise a plurality of longitudinal slots formed in a portion of the cone body. The cone body may be formed from a drillable material. The expansion surface may gradually increase in outer diameter from a leading edge to a maximum expansion diameter. The second portion having the second expansion profile formed thereon may be located between the leading edge of the expansion surface, and the first portion having the first expansion profile formed thereon. The first expansion profile may have a circular cross section.

In one or more aspects, the present disclosure relates to an expansion system comprising a cone body having an expansion surface, a first expansion profile formed in a first portion of the expansion surface, a second expansion profile formed in a second portion of the expansion surface, wherein the second expansion profile includes one or more facets, and an expandable tubular having an inner surface with a receptacle configured to engage with the facets of the second expansion profile. The receptacle may comprise an inner sleeve extending upward into the expandable tubular. The receptacle may be formed to have an inner profile with flat sections that correspond to the one or more facets of the second expansion profile. The receptacle may comprise a plurality of longitudinal slots. The first expansion profile of the cone body may have a circular cross section. The expansion surface may gradually increase in outer diameter from a leading edge to a maximum expansion diameter. The second portion having the second expansion profile formed thereon may be located between the leading edge of the expansion surface, and the first portion having the first expansion profile formed thereon.

In one or more aspects, the present disclosure relates to a method of installing an expandable tubular comprising locking a receptacle to a lower end of the expandable tubular, and generating an axial force on a solid cone assembly. The solid cone assembly includes a cone body formed from a drillable material, the cone body having an expansion surface, a first expansion profile formed in a first portion of the expansion surface, and a second expansion profile formed in a second portion of the expansion surface. The second expansion profile includes one or more facets. The method further comprises pushing the solid cone assembly downward, and engaging the receptacle with the facets of the second expansion profile. The method further comprises drilling the cone body.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
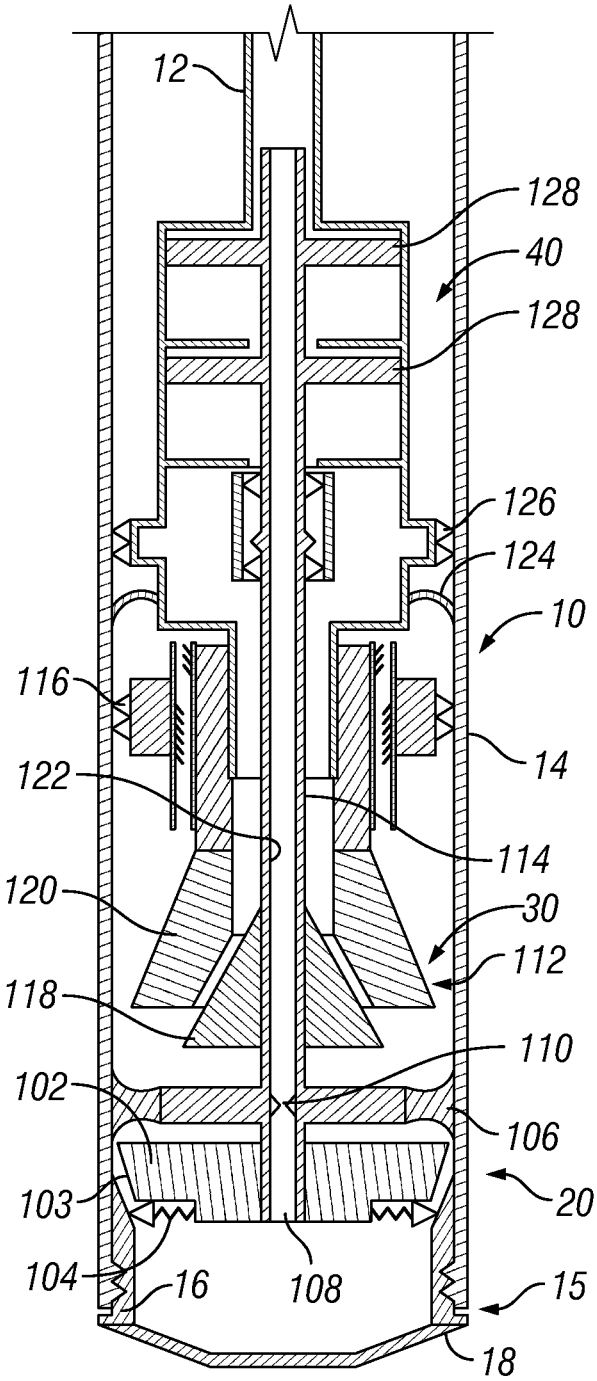
FIG. 1 is a schematic illustration of an expansion system.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, an expansion system 10 includes a solid cone assembly 20, an adjustable cone assembly 30, and an actuator assembly 40. In general, the solid cone assembly 20 is configured to move downward to expand a lower portion of an expandable tubular 14. Once the solid cone assembly 20 has expanded the lower portion of the expandable tubular 14, the adjustable cone assembly 30 is configured to move upward and expand the remainder of the expandable tubular 14. The configuration and sequential operation of the solid cone assembly 20 and the adjustable cone assembly 30 allow for the expansion system 10 to have a minimal external diameter prior to expansion and simplifies drill out of the portions of the assembly that remain in the wellbore following expansion.

FIG. 1 illustrates the expansion assembly 10 in an assembled, or running, mode in which the expansion system 10 is coupled to a work string 12 and disposed within an expandable tubular 14. A shoe 18 is coupled to the lower end of the expandable tubular 14. A receptacle, for example an inner sleeve 16, extends upward into the expandable tubular 14 from the shoe 18. In certain embodiments, the expandable tubular 14 may have a uniform outer diameter and thickness along its entire length. In some embodiments, the lower end of the expandable tubular 14 may include a launcher portion 15 that has larger inner and outer diameters than the expandable tubular 14. The inner sleeve 16 and the shoe 18 may be constructed from drillable materials such as aluminum, brass, bronze, cast iron or other low strength steel, composites such as filament wound plastics, or other drillable materials.

The solid cone assembly 20 forms the lower portion of the expansion system 10 and includes a solid expansion cone 102. The solid expansion cone 102 has an expansion surface 103 that is oriented downward and has an expansion diameter that is larger than the unexpanded inner diameter of the inner sleeve 16 but smaller than the unexpanded inner diameter of the expandable tubular 14. One or more locking members 104 are coupled to a lower end of the solid expansion cone. The solid cone assembly 20 includes a seal member 106 that sealingly engages the expandable tubular 14, and/or the inner sleeve 16 after expansion. The solid cone assembly 20 also includes an axial bore 108 with a seal seat 110 that allows fluid to pass through the solid cone assembly 20.

Adjustable cone assembly 30 includes an adjustable cone 112, a mandrel 114, and a cone lock 116. In certain embodiments, the adjustable cone 112 includes a plurality of primary segments 118 that are coupled to the mandrel 114 and a plurality of secondary segments 120 that are disposed adjacent to the primary segments 118. The secondary segments 120 are axially translatable relative to the mandrel 114 and the primary segments 118. The mandrel 114 includes an axial bore 122 that is fluidically coupled to the axial bore 108 of the solid cone assembly 20.

Actuator assembly 40 includes a seal 124, a casing lock 126, and hydraulic piston assemblies 128. Seal 124 sealingly engages the expandable tubular 14. Casing lock 126 is coupled to the hydraulic piston assemblies 128 and selectively engages the expandable tubular 14 so as to axially couple the expansion system 10 to the expandable tubular 14. Hydraulic piston assemblies 128 include one or more pistons that are coupled to the mandrel 114 so that working fluid supplied to the hydraulic piston assemblies 128 creates an axial force that moves the mandrel 114.

Figure 2A:
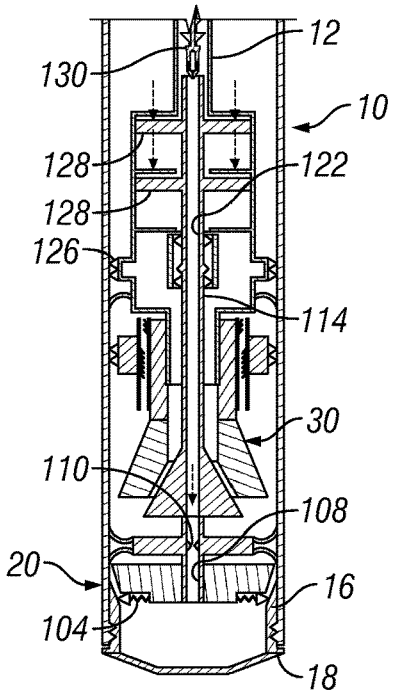
FIGS. 2A-2D illustrate the operation of the expansion system of FIG. 1.

The operation of expansion system 10 is illustrated in FIGS. 2A-2D. FIG. 1 shows the expansion system 10 in a running configuration that is used when running the expansion system to a desired location in a wellbore (not shown). In the running position, working fluid can be pumped from the drilling rig through the work string 12, axial bore 122 of the mandrel 114, axial bore 108 of the adjustable cone assembly 30, and through shoe 18. When the expansion system 10 is in the proper location for installation, an actuation member 130 (such as a dart or a ball), is inserted into, and pumped through, the work string 12 until it engages seal seat 110, as is shown in FIG. 2A.

Figure 2B:
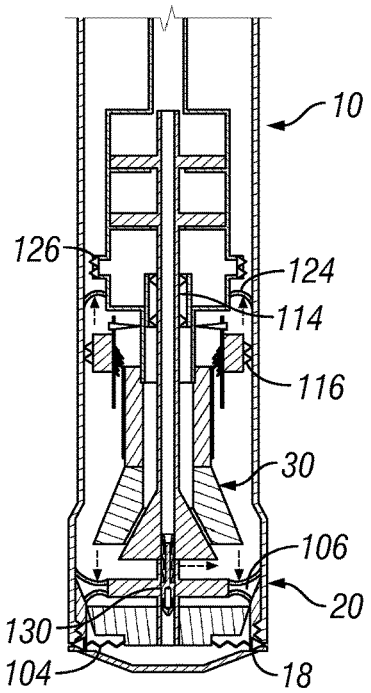

As shown in FIG. 2A, once actuation member 130 engages seal seat 110, fluid from the work string 12 is redirected to the hydraulic piston assemblies 128. The hydraulic piston assemblies 128 generate an axial force on mandrel 114 that pushes the solid cone assembly 20 downward through the inner sleeve 16, causing the radial expansion of both the inner sleeve 16 and the expandable tubular 14, as shown in FIG. 2B. During this expansion, the casing lock 126 is engaged with the expandable tubular 14, preventing axial movement of the expandable tubular 14 relative to the expansion system 10. The solid cone assembly 20 will move downward expanding the inner sleeve 16 and expandable tubular 14 until the hydraulic piston assemblies 128 fully actuate, at which time the locking members 104 of the solid cone assembly 20 engage the shoe 18. The final position of the solid cone assembly 20 is controlled by the stroke length of the hydraulic piston assemblies 128. The length of the shoe 18 may be matched with the stroke length of the hydraulic piston assemblies 128. So when the piston bottoms out after the complete stroke length, the shoe 18 may be fully expanded and the solid cone assembly 20 may be locked in place.

Towards the end of the top-down expansion, casing lock 126 disengages from the expandable tubular 14, and the hydraulic piston assemblies 128 may bottom out on an internal shoulder (in an end of stroke position). As shown in FIG. 2B, the portion of the expandable tubular 14 adjacent to the shoe 18 is fully expanded and the seal member 106 is sealingly engaged with the now expanded portion of the expandable tubular 14. With locking members 104 engaged with the shoe 18, further movement of the solid cone assembly 20 is prevented. Further supply of working fluid through work string 12 and increasing pressure within the mandrel 114 will cause a port (not shown) to open and allow working fluid to enter region of the expandable tubular 14 between the seal 124 and the seal member 106. As the pressure within this region increases, the mandrel 114 will separate from the solid cone assembly 20 and begin moving upward relative to the expandable tubular 14.

Figure 2C:
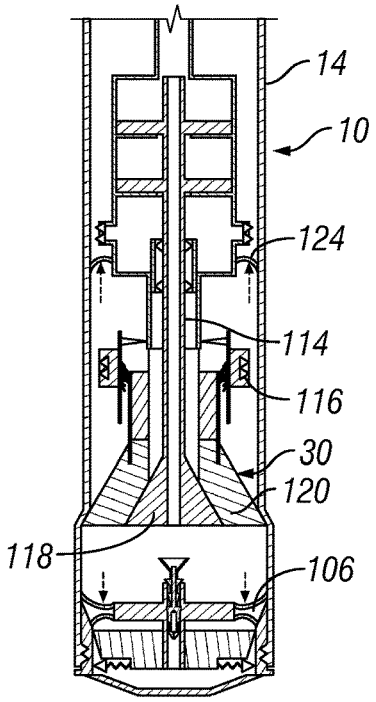

As the mandrel 114 begins moving, the cone lock 116 remains engaged with the expandable tubular 14, thus maintaining the axial position of the secondary segments 120 relative to the expandable tubular 14. As the mandrel 114 moves, the primary segments 118, being coupled to the mandrel 114, move upward and engage the secondary segments 120. This engagement pushes the secondary segments 120 outward until the adjustable cone assembly 30 reaches its full expansion diameter, as is shown in FIG. 2C. Once the adjustable cone assembly 30 has reached its full expansion diameter, cone lock 116 disengages the expandable tubular 14 and locks the secondary segments 120 in place.

Figure 2D:
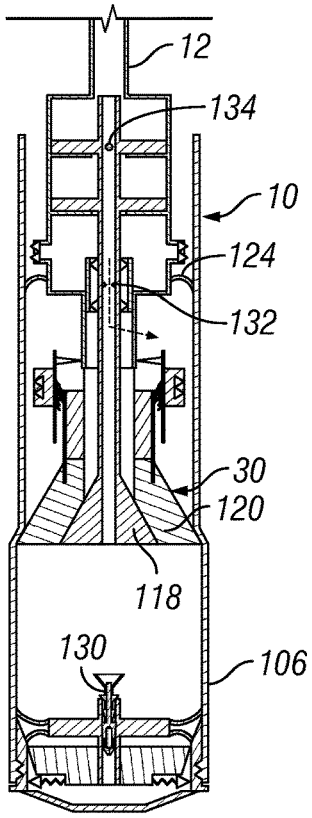

As shown in FIG. 2D, continued supply of working fluid through the work string 12 will push the adjustable cone assembly 30 upward, radially expanding the expandable tubular 14. This expansion may continue until the expandable tubular 14 is entirely expanded. In certain embodiments, mandrel 114 includes a seal seat 132 that can accept a seal member 134 (such as a ball or dart) that will prevent working fluid from passing through the mandrel 114. Once the mandrel is blocked, continued supply of working fluid to the mandrel 114 will move the mandrel 114 downward and move the primary segments 118 out of engagement with the secondary segments 120, thus allowing the adjustable cone assembly 30 to reduce its expansion diameter. This reduction in expansion diameter may allow for the adjustable cone assembly 30 to be pulled axially through an unexpanded portion of the expandable tubular 14.

Figure 3:
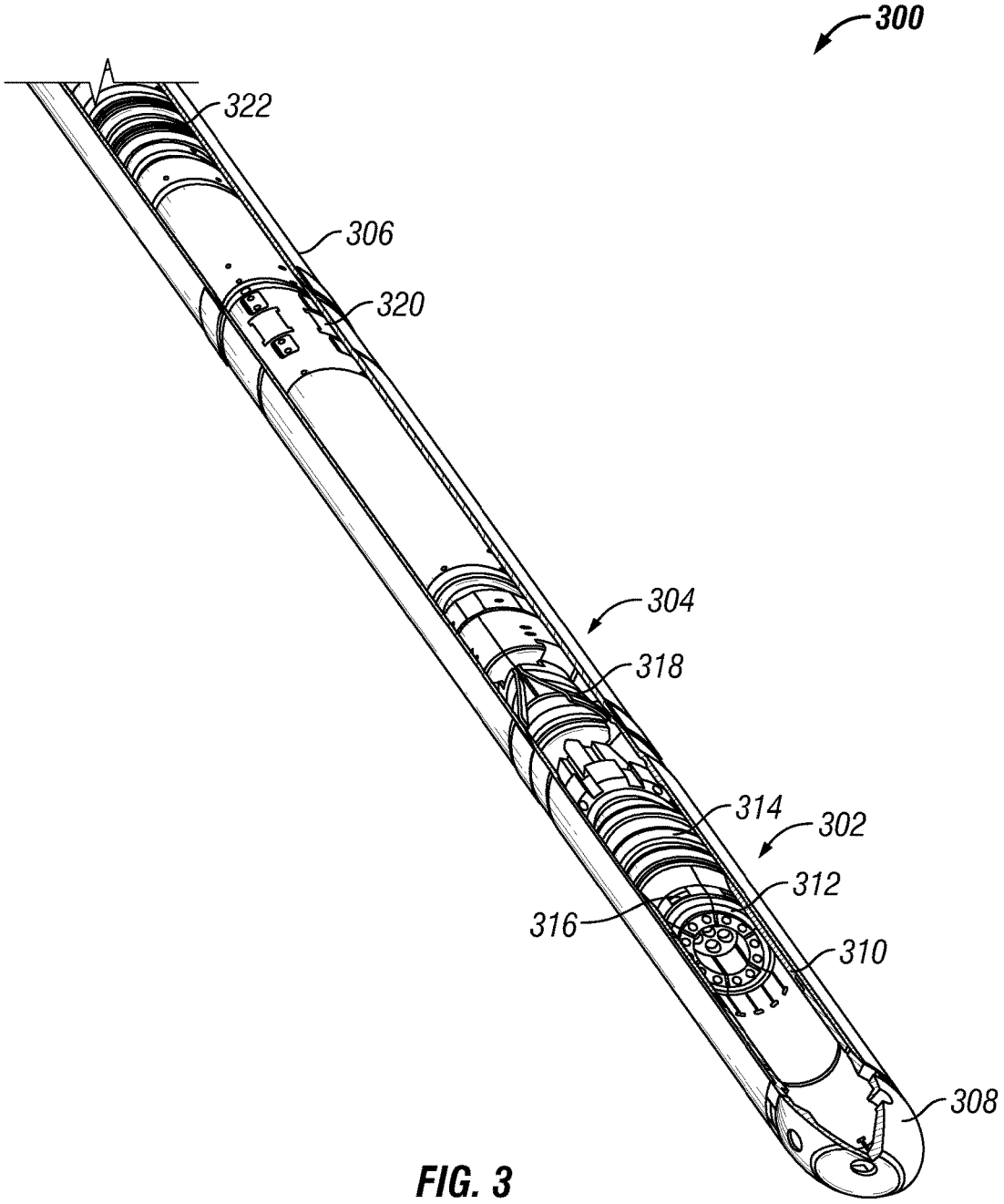
FIG. 3 is a partial sectional view of an expansion system.
Figure 4A:
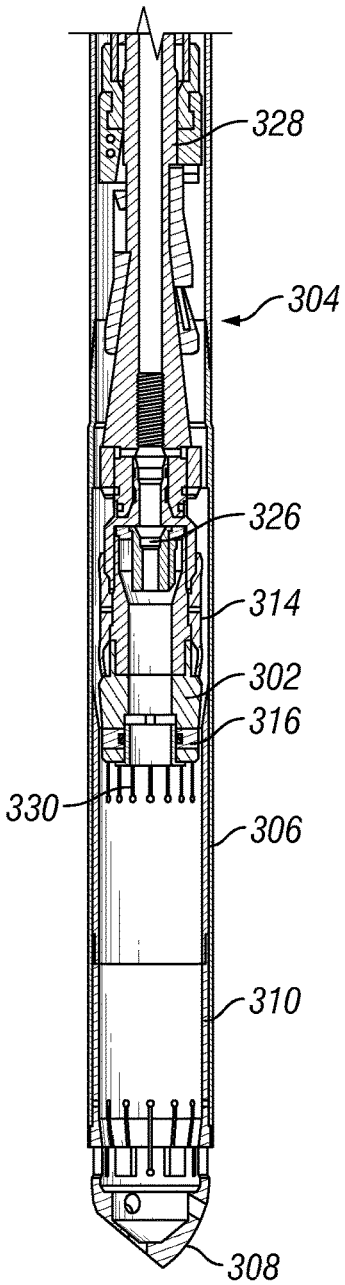
FIGS. 4A-4C illustrate the operation of the expansion system of FIG. 3.

Referring now to FIGS. 3 and 4A, an expansion system 300 includes a solid cone assembly 302, an adjustable cone assembly 304, and a hydraulic actuator assembly (not shown). The expansion system 300 is disposed within an expandable tubular 306 that is coupled to a lower shoe 308. A receptacle, for example an inner sleeve 310 is disposed within the expandable tubular 306 proximate the lower shoe 308. The solid cone assembly 302 includes an expansion cone 312, seal members 314, and locking members 316. The adjustable cone assembly 304 includes adjustable cone segments 318 mounted on a mandrel 328 and a cone lock 320. The expansion system 300 also includes a seal 322 above the adjustable cone assembly 304.

Figure 4B:
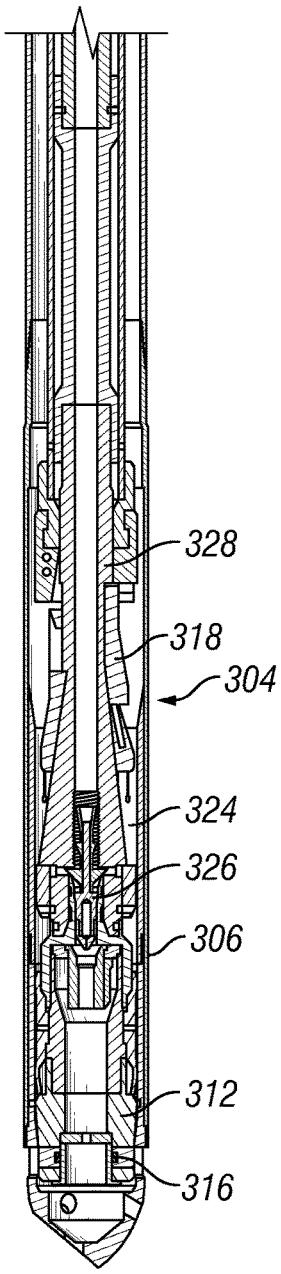
Figure 4C:
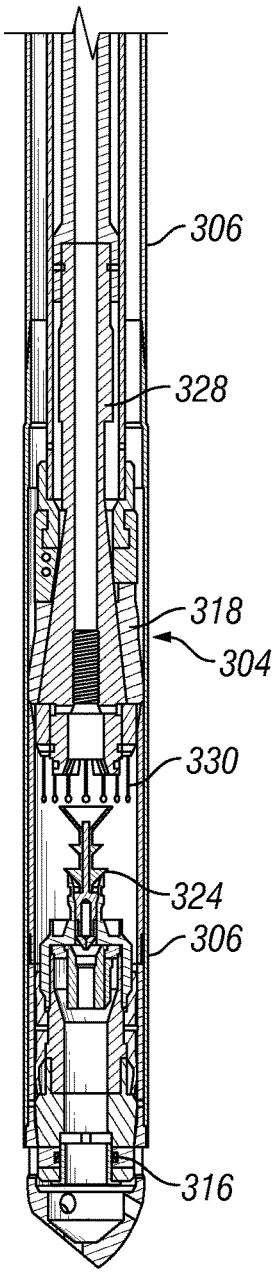

Referring now to FIG. 4B, a dart 324 has been dropped into a seal seat 326 near the top of the solid cone assembly 302. The dart 324 blocks the flow of working fluid through the expansion system 300 and initiates activation of the hydraulic actuator assembly (not shown) that applies an axial force that moves the solid cone assembly 302 and the adjustable cone assembly 304 downward relative to the expandable tubular 306. For example, the hydraulic actuator assembly includes one or more pistons that are coupled to the mandrel 426 so that working fluid supplied to the hydraulic actuator assembly creates an axial force that moves the mandrel 426. As the solid cone assembly 302 moves downward, the expansion cone 312 radially expands the inner sleeve 310 and the expandable tubular 306.

The solid cone assembly 302 and adjustable cone assembly 304 continue moving downward until the locking members 316 of the solid cone assembly 302 engage the lower shoe 308. Once the solid cone assembly 302 is locked to the lower shoe 308, the mandrel 328 of the adjustable cone assembly 304 moves upward relative to the adjustable cone segments 318, which pushes the adjustable cone segments 318 outward to their full expansion diameter. In the full expansion diameter, the adjustable cone assembly 304 continues to move upward, through hydraulic force or by pulling on the mandrel 328, and radially expands the expandable tubular 306.

In certain embodiments, the inner sleeve 310 includes a plurality of longitudinal slots 330 that reduce the forces needed to radially expand that section of the inner sleeve 310 and allow for a more complete drill out once expansion is complete. Referring back to FIG. 4B, it can be seen that the adjustable cone segments 318 are moved outward along the mandrel 328 while still disposed within the inner sleeve 310. Therefore, once the adjustable cone assembly 304 is adjusted to its full expansion diameter, the expandable tubular 306 will be "over-expanded" to an inner diameter equal to the expansion diameter of the adjustable cone assembly 304 plus twice the thickness of the inner sleeve 310. In contrast, the portions of the expandable tubular 306 above the inner sleeve 310 and below the location at which the adjustable cone assembly 304 is adjusted will only be expanded to an inner diameter equal to the full expansion diameter of the adjustable cone assembly 304.

In certain embodiments, this may cause an issue when the solid cone assembly 302 and lower shoe 308 are drilled out of the installed expandable tubular 306 as the tools used for this process may not fully engage the inner wall of the "over-expanded" portion of the expandable tubular 306. The slots 330 may be configured so as to span the entire length of the "over-expanded" portion of the expandable tubular 306 so that, once the remainder of the inner sleeve 310 is removed, the slotted portion will simply fall away from the expandable tubular 306.

Figure 5:
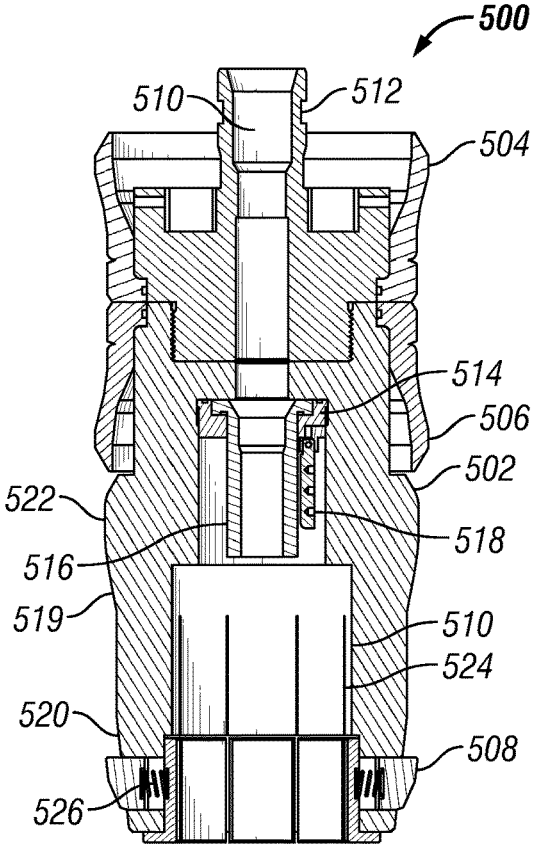
FIG. 5 is a partial sectional view of a solid cone assembly.

Referring now to FIG. 5, one embodiment of a solid cone assembly 500 includes a cone body 502, upward-facing cup seal 504, downward-facing cup seal 506, and locking members 508. The cone body 502 includes a bore 510 having a seal seat 512. A flapper valve 514 and shear tube 516 may also be disposed within the cone body 502.

Before cementing operations, a ball is dropped to sealingly engage the shear tube 516. Differential pressure acting across the ball then breaks the shear tube 516 so that the shear tube falls out of the flapper valve 514 and allows the flapper 518 to close, preventing flow back into the bore 510 from the surrounding wellbore. Downward-facing cup seal 506 provides a seal between the solid cone assembly 500 and a surrounding tubular member, such as the expandable tubular 14 of FIG. 1, that prevents cement slurry from flowing around the outside of the solid cone assembly 500.

Cone body 502 may be constructed from an easily drillable or millable material such as aluminum, brass, bronze, cast iron or other low strength steel, or a composite material such as filament wound plastics. Cone body 502 also includes an expansion surface 519 that gradually increases in outer diameter from its leading edge 520 to a maximum expansion diameter 522. In certain embodiments, a plurality of longitudinal slots 524 may be formed through a portion of the cone body 502 to make later removal of the cone body 502 easier. Locking members 508 may include biasing members 526 that urge the locking members 508 outward.

Figure 6:
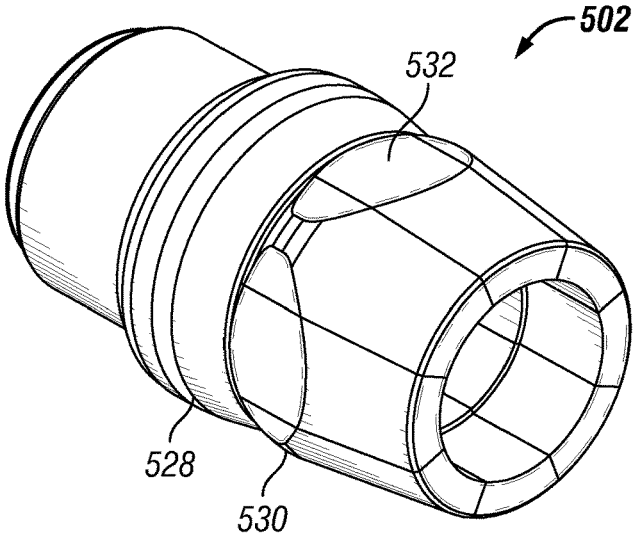
FIG. 6 is a perspective view of a solid cone body.
Figure 7:
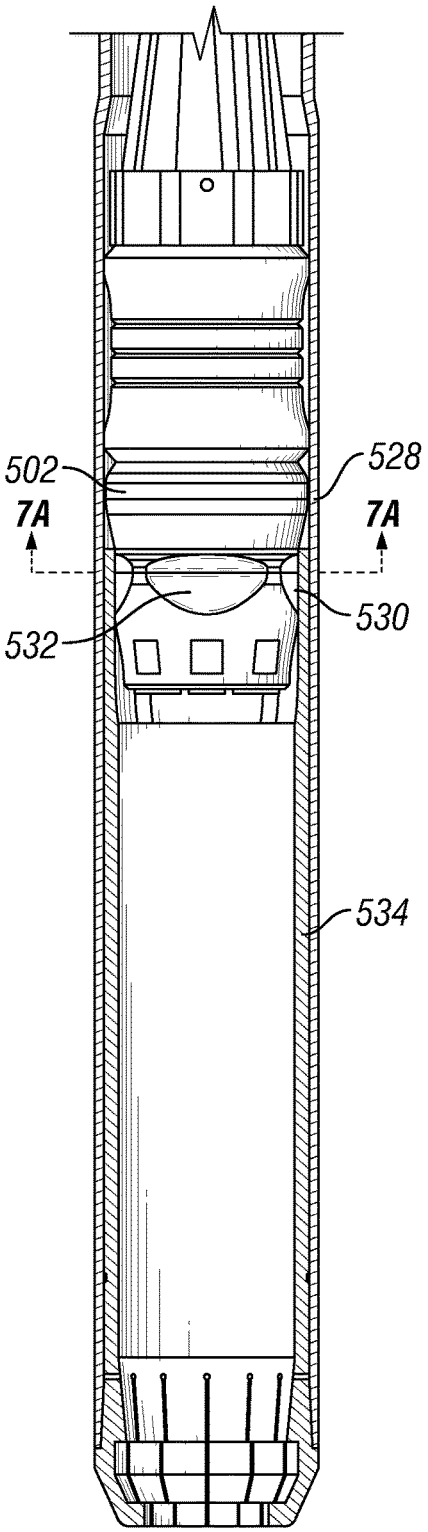
FIGS. 7 and 7A illustrate the solid cone body of FIG. 6 disposed in a tubular member.
Figure 7A:
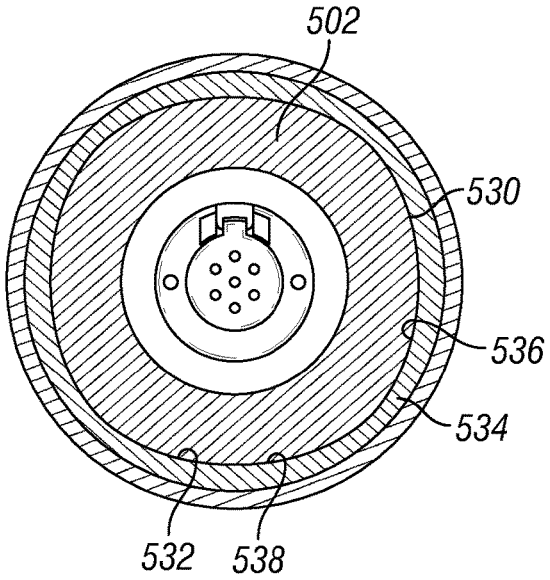

In certain embodiments, the expansion surface 519 may have two distinct profiles. As shown in FIGS. 6 and 7, a cone body 502 may have a circular expansion profile 528, which has a circular cross-section, and a faceted expansion profile 530 which has one or more facets 532 formed on the expansion surface 519. The circular expansion profile 528 may be formed on a first portion of the expansion surface 519. The faceted expansion profile 530 may be formed on a second portion of the expansion surface 519 that is located between the leading edge 520 of the expansion surface 519 and the portion. When in the pre-expansion running position, as shown in FIG. 7, the faceted expansion profile 530 may be disposed in a receptacle of the expandable tubular, for example in the upper end of the inner sleeve 534. As can be seen in FIG. 7A, the inner sleeve 534 may be formed to have an inner profile 536 with flat sections 538 that correspond to the facets 532. In this manner, the cone body 502 is rotationally locked to the inner sleeve 534. Alternatively, the cone body 502 and the faceted expansion profile 530 may be pushed into the receptacle of the expandable and may deform it to generate an inner profile with flat sections that correspond to the facets of the cone body 502.

The inner sleeve 534 may be effectively locked to the expandable tubular 14, for example with an adhesive between the inner sleeve 534 and the expandable tubular 14, and/or with retaining threads on the inner sleeve 534 engaging complementary retaining thread on the expandable tubular 14. This rotational lock facilitates the milling or drilling of at least the upper part of the cone body 502, the lower part disintegrating in small debris separated by the plurality of longitudinal slots 524. In addition, a torque transfer ring on the adjustable cone assembly 304 allows for torque to be transmitted from the work string into the expandable tubular 14 and allows for rotation of the expandable tubular 14 while the tubular is being run into a wellbore.

Figure 8:
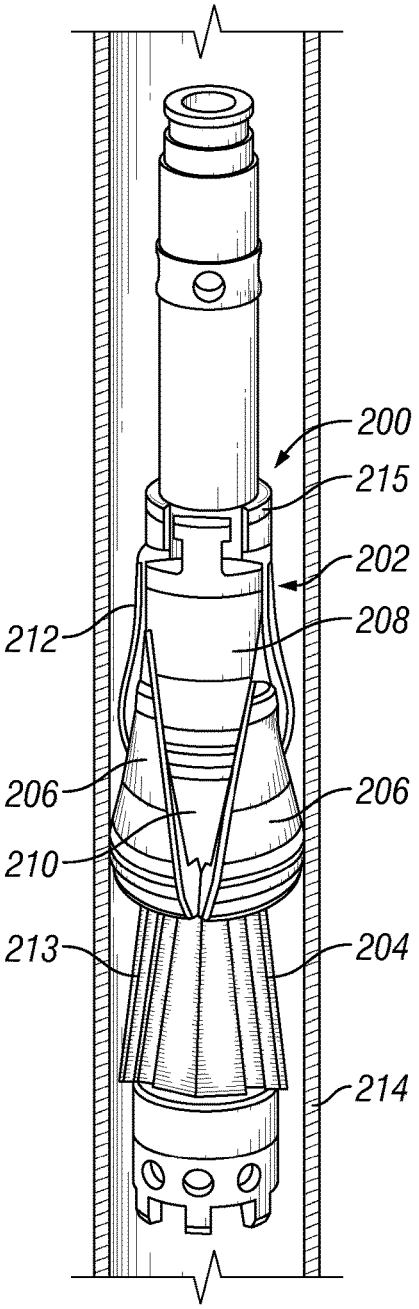
FIGS. 8 and 8A illustrate an adjustable cone assembly in a retracted position.
Figure 9:
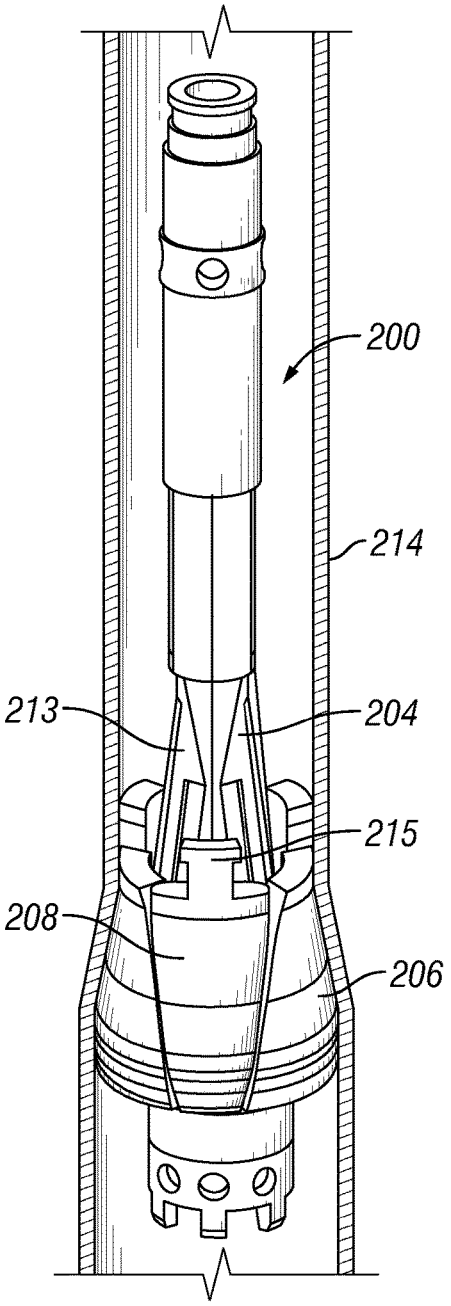
FIGS. 9 and 9A illustrate the adjustable cone assembly of FIG. 8 in an expansion position.

Referring now to FIGS. 8 and 9, one embodiment of an adjustable cone assembly 200 includes a plurality of cone segments 202 that are slidably coupled to a mandrel 204. The cone segments 202 include three primary cone segments 206 that are interleaved with three secondary cone segments 208. Slots 210 on the primary cone segments 206 engage with tabs 212 on the secondary cone segments 208 to maintain alignment and limit axial offset between the cone segments 202. Mandrel 204 also includes guide rails 213 that engage and align the primary cone segments 206 with the mandrel. The secondary cone segments 208 include retention tabs 215 that engage with a housing (not shown) that limits the axial travel of the secondary cone segments 208.

Figure 8A:
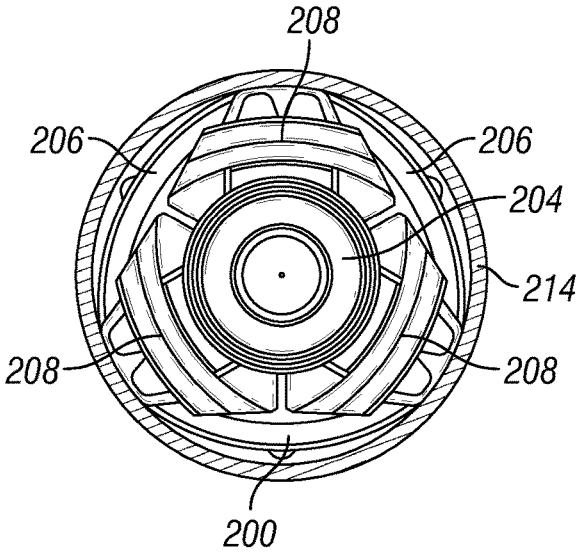
Figure 9A:
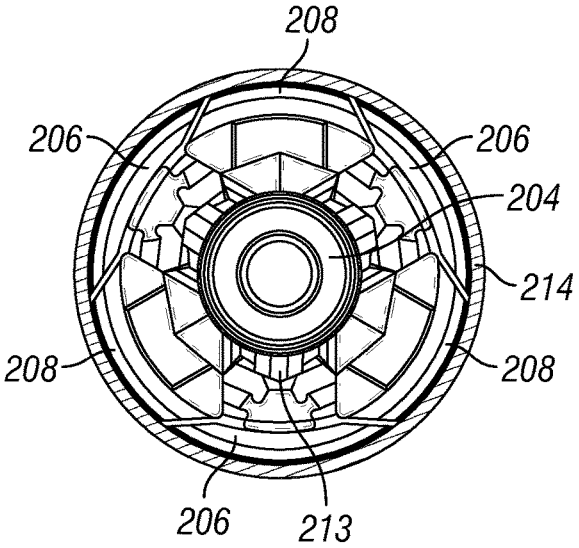

The adjustable cone assembly 200 has a retracted position that is shown in FIGS. 8 and 8A in which the secondary cone segments 208 are axially offset from the primary cone segments 206. The adjustable cone assembly 200 can be disposed within an expandable tubular 214 and run into a wellbore in the retracted position. The adjustable cone assembly 200 is transitioned to an expansion position of FIGS. 9 and 9A by axially translating the mandrel 204 relative to the cone segments 202.

As transition of the adjustable cone assembly 200 is initiated, the cone segments 202 are held in a substantially stationary axial position by engagement of the secondary cone segments 208 with the housing (not shown) and the contact between the primary cone segments 206 and the inner diameter of the expandable tubular 214. The relative axial translation of the mandrel 204 causes the primary cone segments 206 to move radially outward and expand the expandable tubular 214. Continued movement of the mandrel 204 causes the secondary cone segments 208 to move radially outward and expand the expandable tubular 214 into a circular cross-sectional shape. Once adjustable cone assembly 200 has fully transitioned to an expansion position, the cone segments 202 form an expansion cone that can be translated through and radially expand an extended length of the expandable tubular 214. In certain embodiments, guide rails 213 and the primary cone segments 206 are configured so that the movement of the mandrel 204 in the opposite direction can also transition the assembly 200 from the expansion position back to the retracted position.

Figure 10A:
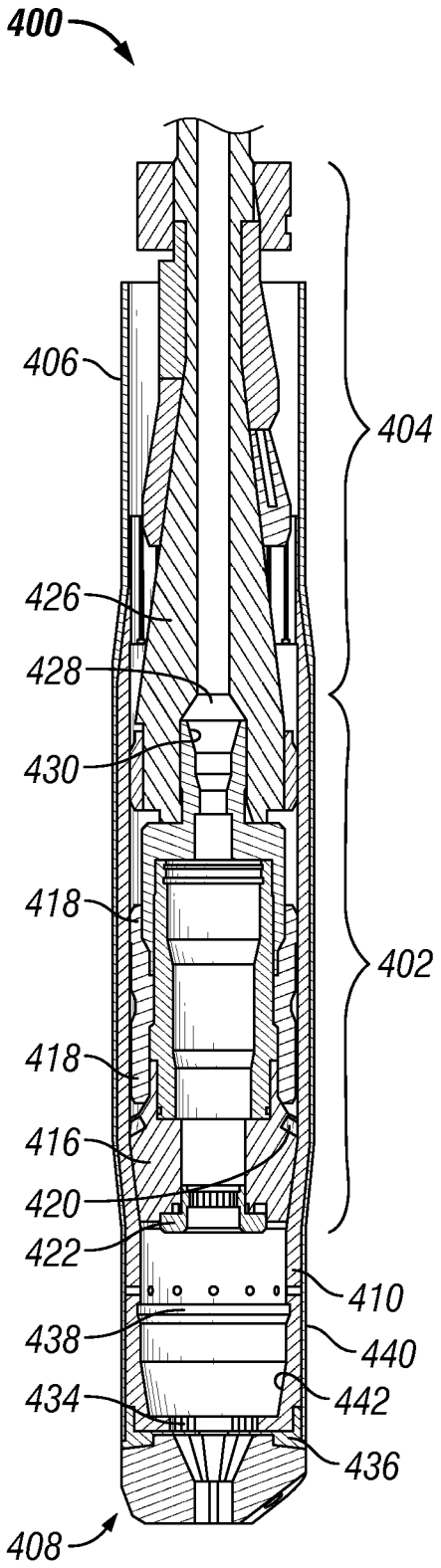
FIGS. 10A and 10B illustrate the operation of an expansion system.
Figure 10B:
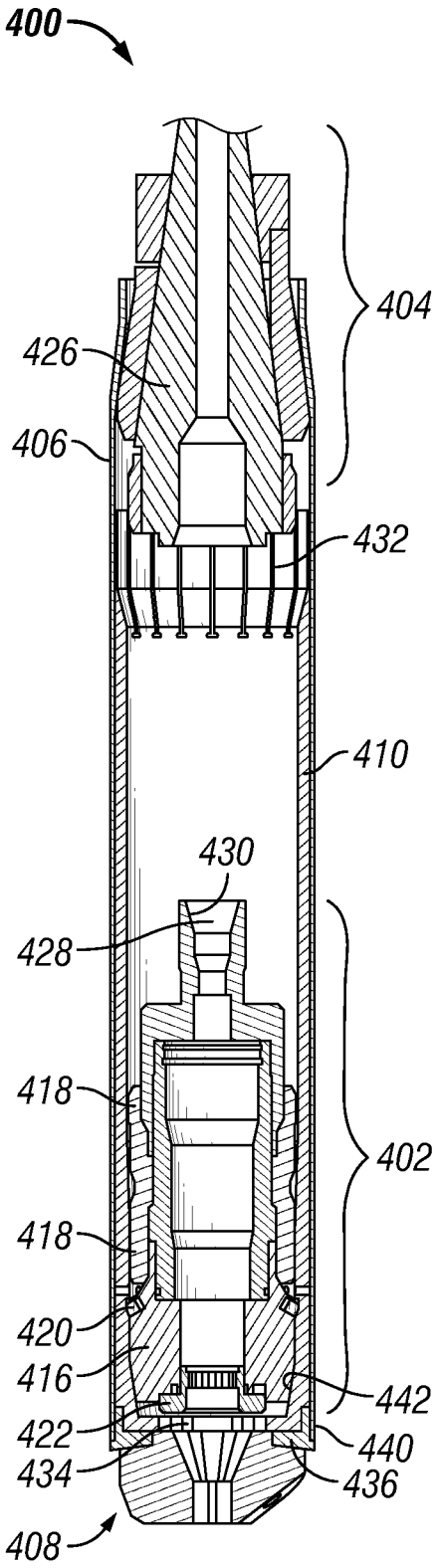

Turning now to FIGS. 10A and 10B, an expansion system 400 includes a solid cone assembly 402, an adjustable cone assembly 404, and a hydraulic actuator assembly (not shown). The expansion system 400 is disposed within an expandable tubular 406. A shoe 408 including a nose is coupled to a lower end of the expandable tubular 406. A receptacle, for example an inner sleeve 410 is disposed within the expandable tubular 406 at the shoe 408. The solid cone assembly 402 includes a cone body 416, seal members 418, and locking members 420. The cone body 416 includes an expansion surface that gradually increases in outer diameter from its leading edge to a maximum expansion diameter. The adjustable cone assembly 404 includes adjustable cone segments 424 mounted on a mandrel 426, which, in certain embodiments, may be similar to the primary cone segments 206 and secondary cone segments 208 shown in FIGS. 8 and 9. The expansion system 400 may also include a seal (not shown) above the adjustable cone assembly 404 to provide hydraulic force to move the adjustable cone assembly upward and radially expands the expandable tubular 406.

In the example of FIGS. 10A and 10B, the solid cone assembly 402 includes a castellation 422 having faces configured to engage corresponding faces of a castellation 434 provided on the inner sleeve 410. The castellation 422 may be located below the leading edge of the expansion surface of the cone body 416. When engaged, the castellations 422 and 434 provide a rotational lock between the solid cone assembly 402 and the inner sleeve 410. This rotational lock facilitates the milling or drilling of the cone body 416. The solid cone assembly may also include locking members 420 that, in the example shown in FIGS. 10A and 10B, are located above the maximum diameter of the cone body 416. As such, the amount of material of the shoe 408 that is not drilled and may fall into the wellbore is reduced. The locking members may include a plurality of dogs expanding into groove located in the shoe 408. The dogs may include spring loaded cone segments that expand radially at an acute angle relative to the shoe inner surface.

In certain embodiments, the inner sleeve 410 includes a plurality of longitudinal slots 432 that reduce the forces needed to radially expand that section of the inner sleeve 410 and allow for a more complete drill out once expansion is complete. The slots 432 may be configured so that, once the remainder of the inner sleeve 410 is removed by drilling, the slotted portion will simply fall away from the expandable tubular 406. The inner sleeve 410 may further be effectively locked to the expandable tubular 406, for example via a threaded portion 440 including retaining threads on the inner sleeve 410 engaging complementary retaining thread on the expandable tubular 406. The threads may be configured to prevent parts of the inner sleeve 410 from falling in the wellbore as the inner sleeve 410 is milled after expansion of the expandable tubular 406. In other words, the retaining threads may be used to retain the slotted portion of the inner sleeve 410 against the expandable tubular 406 as long as possible during drilling so as to minimize the size of debris falling away from the expandable tubular 406. The inner surface of the expandable tubular 406 may further include a corresponding threaded portion that engages the threaded portion 440 of the inner sleeve 410.

The inner sleeve 410 may further include a segmented ring 436 located adjacent to bottom end of the expandable tubular 406. The segmented ring 436 may permit uniform expansion of the expandable tubular 406 down to the bottom of the expandable tubular 406 by providing radial support to expand the expandable tubular 406 while reducing hoop stress. The inner sleeve 410 may further include a inwardly tapered portion 442 located adjacent to bottom end of the expandable tubular 406, and adjacent to the segmented ring 436. The tapered portion 442 may also permit uniform expansion of the expandable tubular 406 down to the bottom of the expandable tubular 406 while keeping the solid cone assembly 402 locked within an interior of the expandable tubular 406 where it can be milled after expansion of the expandable tubular.

In use, a dart (no shown) is dropped into a seal seat 430 near the top of the solid cone assembly 402. The dart blocks the flow of working fluid through passageway 428 in the expansion system 400 and initiates activation of the hydraulic actuator assembly (not shown) that applies an axial force that moves the solid cone assembly 402 and the adjustable cone assembly 404 downward relative to the expandable tubular 406. For example, the hydraulic actuator assembly includes one or more pistons that are coupled to the mandrel 426 so that working fluid supplied to the hydraulic actuator assembly creates an axial force that moves the mandrel 426. As the solid cone assembly 402 moves downward, the cone body 416 radially expands the inner sleeve 410 and the expandable tubular 406, as illustrated in FIG. 10A.

The solid cone assembly 402 and adjustable cone assembly 404 continue moving downward until the locking members 420 of the solid cone assembly 402 engage a groove 438 located in shoe 408 as illustrated in FIG. 10B. At the end top-down expansion, the engagement of the locking members 420 and the shoe 408 prevents further upward movement of the solid cone assembly 20. Also, the solid cone assembly 402 may abut a wall section on the inner sleeve 410 that may by sufficiently thick so that the expansion forces are sufficiently high to prevent further downward movement of the solid cone assembly 402. Once the solid cone assembly 402 is locked to the shoe 408, the mandrel 426 of the adjustable cone assembly 404 moves upward relative to the adjustable cone segments 424, which deploys the adjustable cone segments 424 outward to their full expansion diameter. In the full expansion diameter, the adjustable cone assembly 404 continues to move upward, through hydraulic force or by pulling on the mandrel 426, and radially expands the expandable tubular 406.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A solid cone assembly comprising:

a solid cone body having an expansion surface, wherein the expansion surface gradually increases in outer diameter from a leading edge to a maximum expansion diameter;

a first expansion profile formed in a first portion of the expansion surface, wherein the first expansion profile has a circular cross section;

either a second expansion profile formed in a second portion of the expansion surface, wherein the second expansion profile includes one or more facets, or a castellation included in the solid cone body; and a locking member coupled to an outer surface of the solid cone body, wherein the locking member includes a biasing member that urges the locking member outward.

2. The solid cone assembly of claim 1, further comprising a seal member coupled to an outer surface of the solid cone body.

3. The solid cone assembly of claim 2, wherein the seal member includes a downward-facing cup seal and an upward-facing cup seal.

4. The solid cone assembly of claim 2, further comprising a bore disposed in the solid cone body.

5. The solid cone assembly of claim 4, further comprising a seal seat formed in the bore.

6. The solid cone assembly of claim 4, further comprising a flapper valve and shear tube disposed in the bore.

7. The solid cone assembly of claim 1, further comprising a plurality of longitudinal slots formed in a portion of the solid cone body.

8. The solid cone assembly of claim 7, wherein the solid cone body is formed from a drillable material.

9. The solid cone assembly of claim 1, wherein either the second portion having the second expansion profile formed thereon is located between the leading edge of the expansion surface and the first portion having the first expansion profile formed thereon or the castellation of the solid cone body is located below the leading edge of the expansion surface of the solid cone body.

10. A method of installing an expandable tubular comprising:

locking a receptacle to a lower end of the expandable tubular, wherein the receptacle comprises an inner sleeve extending from a lower end of the expandable tubular upward in the expandable tubular;

generating an axial force on a solid cone assembly including a solid cone body formed from a drillable material, the solid cone body having an expansion surface, wherein the expansion surface gradually increases in outer diameter from a leading edge to a maximum expansion diameter, a first expansion profile formed in a first portion of the expansion surface, wherein the first expansion profile has a circular cross section, and either a second expansion profile formed in a second portion of the expansion surface, wherein the second expansion profile includes one or more facets, or a castellation included in the solid cone body;

pushing the solid cone assembly downward;

engaging the receptacle either with the facets of the second expansion profile or with the castellation of the solid cone body; and drilling an upper part of the solid cone body.

11. The method of claim 10 further comprising engaging a lower shoe of the expandable tubular with locking members coupled to an outer surface of the solid cone body, wherein the locking members include biasing members that urge the locking members outward.

12. The method of claim 10 further comprising disintegrating a lower part of the solid cone body in small debris separated by a plurality of longitudinal slots formed in a portion of the solid cone body.

13. The method of claim 10 wherein the receptacle is formed to have either an inner profile with flat sections that correspond to the facets of the second expansion profile, or a castellation with faces corresponding to faces of the castellation of the solid cone body.

14. The method of claim 13 wherein either engaging the receptacle with the facets of the second expansion profile comprises engaging the flat sections of the receptacle with the facets of the second expansion profile, or engaging the receptacle with the castellation of the solid cone body comprises engaging the faces of the castellation of the receptacle with the faces of the castellation of the solid cone body.

* * * * *